US011993898B2

(12) United States Patent
Thieme et al.

(10) Patent No.: US 11,993,898 B2
(45) Date of Patent: May 28, 2024

(54) SELF-PROPELLED CONSTRUCTION MACHINE OR MINING MACHINE

(71) Applicant: Wirtgen GmbH, Windhagen (DE)

(72) Inventors: Holger Thieme, Vettelschoss (DE); Winfried von Schönebeck, Kalenborn (DE)

(73) Assignee: Wirtgen GmbH, Windhagen (DE)

( * ) Notice: Subject to any disclaimer, the term of this patent is extended or adjusted under 35 U.S.C. 154(b) by 225 days.

(21) Appl. No.: 17/692,265

(22) Filed: Mar. 11, 2022

(65) Prior Publication Data

US 2022/0290384 A1 Sep. 15, 2022

(30) Foreign Application Priority Data

Mar. 15, 2021 (DE) ..... 10 2021 106 221.7

(51) Int. Cl.
*E01C 23/088* (2006.01)
*E01C 23/12* (2006.01)
*E21C 47/00* (2006.01)

(52) U.S. Cl.
CPC ..... *E01C 23/088* (2013.01); *E01C 23/127* (2013.01); *E21C 47/00* (2013.01)

(58) Field of Classification Search
CPC ..... E01C 23/093; E01C 21/00; E01C 23/088; E01C 23/096; E01C 23/127; E01C 23/0913; E21C 47/00; E02F 3/815; E02F 3/8152; E02F 3/8155; B28D 1/18
See application file for complete search history.

(56) References Cited

U.S. PATENT DOCUMENTS 4,561,145 A * 12/1985 Latham ..... E01C 23/088 15/348
5,607,255 A * 3/1997 Thomas ..... E01C 23/0993 404/93
2016/0130772 A1* 5/2016 Berning ..... E01C 23/127 299/39.2
2017/0073908 A1* 3/2017 Lee ..... E01H 1/056
2017/0254032 A1 9/2017 Husar

FOREIGN PATENT DOCUMENTS

EP 0143003 A2 * 5/1985

* cited by examiner

*Primary Examiner* — Christopher J Sebesta
*Assistant Examiner* — Michael A Goodwin
(74) *Attorney, Agent, or Firm* — Lucian Wayne Beavers; Patterson Intellectual Property Law, PC

(57) ABSTRACT

In a self-propelled construction machine or mining machine, in particular milling machine for working a ground surface, including a machine frame, a working device for working the ground surface, which is supported on the machine frame, wherein the working device is at least partially enclosed by a housing, at least one movable side plate, which closes the housing on at least one of the two sides of the working device , wherein the movable side plate rests on the ground surface in floating position during the working operation, it is provided that a clearing scraper is arranged in front of the at least one movable side plate as seen in the direction of travel, wherein the clearing scraper comprises at least one clearing edge for penetrating ground material lying on the ground surface in front of the movable side plate, and clears the ground material for the movable side plate so that the movable side plate may rest on the ground surface.

20 Claims, 4 Drawing Sheets

SELF-PROPELLED CONSTRUCTION MACHINE OR MINING MACHINE

BACKGROUND OF THE INVENTION

Field of the Invention

The present invention relates to a self-propelled construction machine or mining machine.

Description of the Prior Art

Construction machines or mining machines, in particular milling machine such as, for example, surface miner, road milling machine or recycler for working a ground surface are known, which comprise a machine frame. A working device, in particular a milling drum for working the ground surface, is usually provided on said machine frame. The working device is supported on the machine frame, wherein the working device is at least partially enclosed by a housing. Furthermore, at least one movable side plate is frequently provided, which closes the housing on at least one of the two sides of the working device, wherein the movable side plate rests on the ground surface in floating position during the working operation.

In self-propelled construction machines or mining machines, in particular surface miners, the ground pavement worked by means of the working device is frequently not loaded on a transport vehicle but remains on the worked area of the ground surface. It may, in principle, be the case that such machines may comprise a milling drum as working device and a material conveying device consisting of transport conveyors, which may be used to load the worked ground pavement.

There are also machines, however, which comprise a milling drum as working device and do not remove the milled-off material via transport conveyors but leave the material on the worked area of the ground surface for later removal or further processing. In such operation, the housing surrounding the working device is not closed down to the ground surface in a section behind the milling drum, but the worked material may leave the housing behind the milling drum and remains on the ground surface after working. When the construction machine or mining machine mills a second milling cut next to the first milling cut, there is frequently the problem that the at least one movable side plate rests on the previously milled-off ground material and not on the area of the ground surface that has already been worked. The movable side plate rests neither on the worked area nor on the area still to be worked. Since the milling depth is frequently determined by means of the movable side plate, this may result in inaccuracies.

This disadvantage occurs both in machines that are not equipped with a material conveying device such as, for example, transport conveyors, as well as in machines where such a conveying device is, in principle, in place but is not used for the current work assignment.

SUMMARY OF THE INVENTION

It is therefore the object of the present invention to create a self-propelled construction machine or mining machine, in particular milling machines, for working a ground surface, in which a more precise working of the ground surface is possible.

The above mentioned object is achieved by the features of the claims.

The present invention advantageously provides that a clearing element is arranged in front of the at least one movable side plate as seen in the direction of travel, wherein the clearing element comprises at least one clearing edge, by means of which the clearing element may penetrate ground material lying on the ground surface in front of the movable side plate, and clears the ground material for the movable side plate so that the movable side plate may rest on the ground surface.

Milling machines may be, for example, surface miner, road milling machine or recycler.

The present invention has the advantage that, by providing an additional clearing element, the area in front of the movable side plate is cleared and the movable side plate may rest on the ground surface. In this way, a more precise determination of the milling depth is possible.

The clearing element may be pivotable about a pivoting axis, wherein the pivoting axis preferably extends essentially orthogonal to the direction of travel.

The working device may be, for example, a milling drum. The milling drum may feature a milling drum axis, which is supported on the machine frame. The pivoting axis may preferably be arranged parallel to the milling drum axis.

In operating position, the pivoting axis may be offset horizontally and/or vertically in relation to the clearing edge.

The clearing element may feature a stowing position as well as an operating position.

According to the present invention, in operating position means that the clearing element can penetrate ground material to be cleared in front of the movable side plate, or is at the level of the ground surface that a travelling device of the ground working machine rests on. When it is not in operating position, the clearing element may also be pivoted into a pivoted-in position. Said position may also be termed stowing position or transport position. In said stowing position, the clearing element is pivoted-in in such a manner that the clearing element does not project downwards in relation to the travelling device of the ground working machine or is not on the level of the ground surface that the travelling device of the ground working machine rests on. In particular, the clearing element is above the ground surface and does therefore not come into contact with the ground surface when in the stowing position. In the stowing position, the clearing element can therefore not penetrate ground material lying on the ground surface in front of the movable side plate.

In operating position, the pivoting axis may be arranged in front of the clearing edge as seen in the direction of travel.

The pivoting axis may, at least when the clearing element is in operating position, be further away from the ground surface than the clearing edge.

The clearing edge may feature, at least in a first clearing edge section, a first contour, which in operating position is curved, in the direction of the ground surface, in the direction of travel.

Due to the contour of said first clearing edge section, the force acting on said first clearing edge section as a result of penetrating the ground material may be directed in such a manner that the clearing edge digs deeper into the ground material. The directed force therefore acts in the direction of the ground material.

The clearing edge may feature, at least in a second clearing edge section, such contour, which in operating position is curved, in the direction of the ground surface, in a direction opposite to the direction of travel.

The contour in the second clearing edge section may be shaped in such a manner that the clearing element tapers towards the free end.

The force acting on the second clearing edge section as a result of penetrating the ground material in operating position may be directed by means of the contour of the second clearing edge section in such a manner that the force acts upwards, that is, away from the ground pavement, and therefore pushes the clearing element upwards out of the ground material.

The second clearing edge section is preferably arranged in the area of the free end of the clearing edge element. The result is that, especially when the clearing edge element encounters a solid ground surface in the lower area, said force, which originates from said ground surface, acts on the second clearing edge section, and due to the special contour of the second clearing edge section, the force is directed in such a manner that it pushes the clearing edge element out of the ground material.

For the purposes of the present invention, upwards means in a direction acting upwards away from the ground surface. Downwards, for the purposes of the present invention, means in the direction of the ground surface.

The first clearing edge section may be arranged above the second clearing edge section.

The ground surface that the movable side plate rests on may be a previously milled area of the ground surface, and the ground material that the clearing element penetrates may be previously milled ground material lying on the ground surface.

However, the ground material may alternatively also be ground material that merely lies on the ground surface as loose ground material.

In operating position, the center of gravity of the clearing element may be arranged relative to the pivoting axis in such a manner that the own weight of the clearing element pushes the clearing element in the direction of the ground surface.

The contour of the first clearing edge section may be shaped in such a manner that, in operating position, the force acting on the first clearing edge section as a result of penetrating the ground material is directed in such a manner that at least a portion of the force pushes the clearing element in the direction of the ground surface.

As already explained above, the result may be that the clearing element is pushed further into the ground material and therefore partially digs into the ground material.

An actuator element may be provided, which may transfer the clearing element from the operating position into the stowing position. An adjustment from the stowing position into the operating position may be effected without applying an additional force, for example, solely through the force of gravity acting on the clearing element. The adjustment of the clearing element from the stowing position into the operating position may, however, also be effected by the actuator element or supported by the same.

In particular, an actuator element may be provided that may pivot the clearing element. The actuator element may pivot the clearing element from an operating position into a stowing position. In this case, the actuator element would apply a force to the clearing element in such a manner that the force pivots the clearing element away from the ground pavement.

The actuator element may be a hydraulic or pneumatic cylinder.

The actuator element may also be used to apply an additional force to the clearing element in operating position, wherein the force pushes the clearing element in the direction of the ground surface. The actuator element may then also perform the adjustment of the clearing element from the stowing position into the operating position or support the same.

As soon as the horizontal and/or vertical portion of the force acting on the clearing edge in operating position as a result of penetrating the ground is larger than the force exerted on the clearing element as a result of the own weight and/or the actuator element, the clearing element is pivoted about the pivoting axis in such a manner that the clearing element moves away from the ground pavement.

As a result of an offset arrangement of the pivoting axis in relation to the clearing edge, the horizontal portion of the force may also contribute to pivoting the clearing element.

This occurs, for example, when the clearing element encounters a hard obstacle in the ground pavement. In this case, the horizontal and/or vertical portion of the force is sufficiently large for the clearing element to be pivoted in such a manner that it moves away from the ground pavement.

The contour of the second clearing edge section may be shaped in such a manner that, in operating position, the force acting on the second clearing edge section as a result of penetrating the ground material is directed in such a manner that at least a portion of the force pivots the clearing element and moves it away from the ground surface.

The own weight and/or the force of the actuator element and/or the contour of the first and/or the second clearing edge section may be selectable in such a manner that the clearing element may penetrate the ground material, which exhibits a density that is lower than a predefined density.

The clearing element and/or the actuator element and/or the contour of the first or the second clearing edge section may thus be selected in such a manner that, for example, loose material is cleared away by the clearing element, wherein the clearing element does not penetrate more solid material.

Comparative tests may be performed, for example, which are tested for specific materials and different densities of the materials that are generally worked by such self-propelled construction machine or mining machine such as, for example, a surface miner. In the process, it may be individually selected for each single construction machine or mining machine, by the correct selection of the own weight and/or the force of the actuator element and/or the contour of the first and/or the second clearing edge element, which type of material or which density of material, respectively, the clearing element may still penetrate, and which it may not. This may be established by comparative tests and adjusted accordingly for a specific model series of ground working machines.

The force of the actuator element could also be adjustable so that, in an existing ground working device, it could be adjustable which material, or which density of material, respectively, the clearing element may still penetrate, and which it may not.

The clearing element may be arranged on a travelling device of the construction machine or mining machine.

The travelling device may be, for example, a tracked ground-engaging unit or wheels of the construction machine or mining machine.

The construction machine or mining machine may also comprise at least two clearing elements, wherein one clearing element is provided on each side of the machine, that is, in front of each of the side plates. The clearing elements may then be pivoted into the operating position or stowing position on each of the two sides of the construction machine or mining machine individually in accordance with requirements.

In floating position means that the movable side plate follows the contour of the ground surface or the ground material that it rests on, respectively, as a result of own weight or a light pressure applied in order to shield the housing towards the outside.

When the movable side plate rests on the ground surface in floating position during the working operation, the working device may work the ground surface.

In the following, one embodiment of the present invention is explained in more detail with reference to the drawings.

BRIEF DESCRIPTION OF THE DRAWINGS

The following is shown schematically.

DETAILED DESCRIPTION

Figure 1:
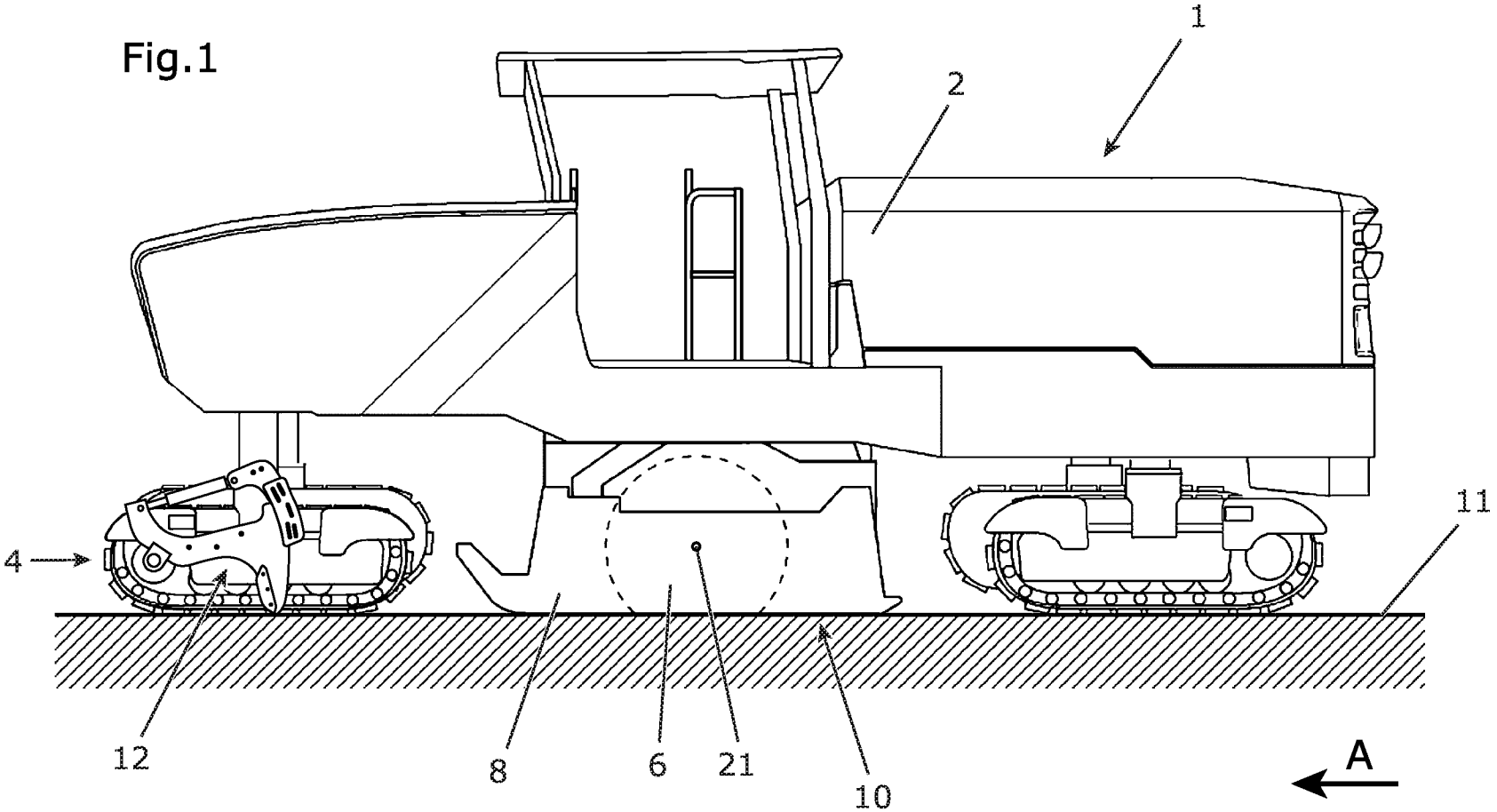
FIG. 1 a self-propelled construction machine or mining machine.

FIG. 1 shows a self-propelled construction machine or mining machine 1. The self-propelled construction machine or mining machine 1 may be, for example, a surface miner. The self-propelled construction machine or mining machine 1 preferably comprises a machine frame 2. A working device may be arranged on the machine frame 2. The working device 6 may preferably be a milling drum. The working device 6 is at least partially enclosed by a housing 10. At least one movable side plate 8 is provided, which closes the housing 10 from at least one of the two sides of the working device 6, wherein the movable side plate 8 rests on the ground surface 11 in floating position during the working operation.

In floating position means that the movable side plate 8 follows the contour of the ground surface or the ground material that it rests on, respectively, as a result of own weight or a light pressure applied by a non-depicted adjustment device in order to shield the housing 10 towards the outside.

In the present embodiment, the clearing element 12 according to the present invention is arranged on one of the travelling devices 4 in front of the movable side plate 8 as seen in the direction of travel A. The travelling devices 4 may also be referred to as ground engaging units 4, which may include wheels or tracks. The clearing element 12 may also be referred to as a clearing scraper 12 or as a clearing ripper 12.

Figure 2:
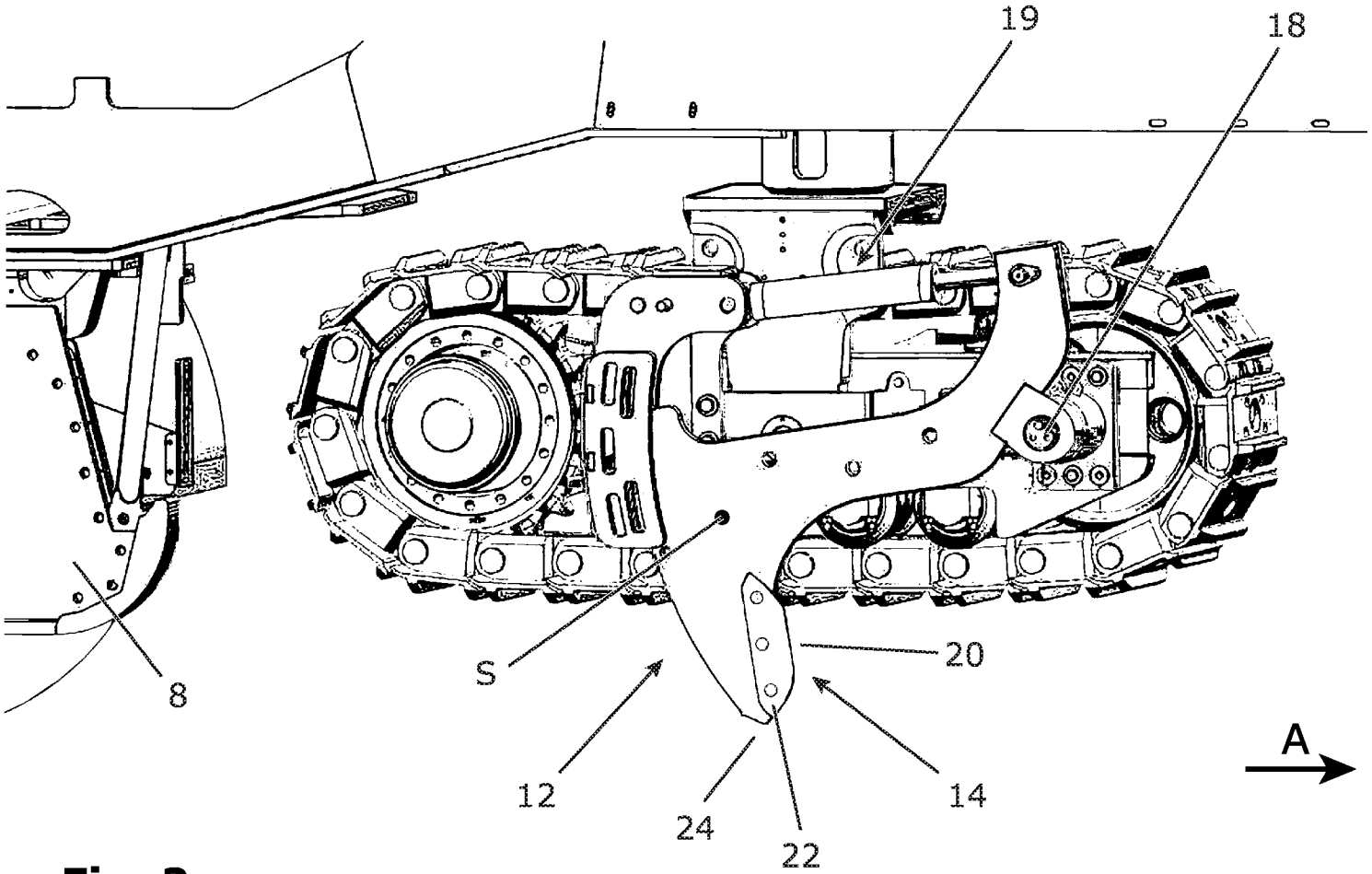
FIG. 2 a clearing element according to the present invention.

The clearing element is depicted in more detail in FIG. 2. The clearing element 12 is arranged in front of the at least one movable side plate 8 as seen in the direction of travel A, wherein the clearing element 12 comprises at least one clearing edge 14, by means of which the clearing element 12 may penetrate ground material 16 lying on the ground surface in front of the movable side plate, and clears the ground material 16 for the movable side plate 8 so that the movable side plate 8 may rest on the ground surface 11. The clearing element 12 may be pivotable about a pivoting axis 18, wherein the pivoting axis 18 preferably extends essentially orthogonal to the direction of travel A. Provided that the working device 6 is a milling drum, said milling drum 6 may feature a milling drum axis 21, which is supported on the machine frame 2. The pivoting axis 18 is preferably arranged parallel to the milling drum axis 21.

In operating position, the pivoting axis 18 is offset horizontally and/or vertically in relation to the clearing edge 14. In the present embodiment, the pivoting axis 18 is arranged in front of the clearing edge 14 as seen in the direction of travel A. Furthermore, in the present embodiment, the pivoting axis 18 is arranged above the clearing edge 14. In the present invention, above the clearing edge means in the direction away from the ground surface. In FIG. 2, the clearing element 12 is depicted in operating position. In operating position means that the clearing element 12 penetrates the ground material 16. This is always the case when the clearing element 12 projects downwards in relation to the travelling device 4 or rests on the ground surface that the travelling devices rest on.

The centre of gravity S of the clearing element 12 is depicted in FIG. 2. The center of gravity S of the clearing element 12 is arranged relative to the pivoting axis 18 in such a manner that the own weight of the clearing element 12 pushes in the direction of the ground pavement.

An actuator element 19 is preferably also provided, which in operating position applies an additional force to the clearing element 12, wherein the force pushes the clearing element 12 in the direction of the ground surface. The actuator element 19 may be, for example, a hydraulic or pneumatic cylinder. The actuator element 19 may also be used to pivot the clearing element into the stowing position. In the stowing position, the clearing element 12 does not project downwards in relation to the lower edge of the travelling device. The actuator element 19 may also be referred to as an actuator 19.

As soon as the horizontal and/or vertical portion of the force acting on the clearing edge 14 in operating position as a result of penetrating the ground is larger than the force exerted on the clearing element 12 as a result of the own weight and/or the actuator element 19, the clearing element 12 is pivoted about the pivoting axis in such a manner that the clearing element 12 moves away from the ground surface 11.

This means that, when the clearing element encounters an obstacle in the ground material, or the clearing element encounters the solid and dense ground surface, the horizontal and/or vertical portion of the force increases to such an extent that the clearing element 12 pivots away from the ground pavement.

It is also intended for the clearing element 12 to be adjusted or selected, respectively, in such a manner that the clearing element 12 does specifically not penetrate a solid material, since the clearing element 12 is intended to solely clear loose material to the side and is not intended to penetrate the ground surface 11 to be milled.

In addition, however, the contour of the clearing edge 14 may also be shaped in such a manner that the clearing element 12 is supported in penetrating loose ground material on the one hand and in being pivoted away from excessively solid ground material 16 on the other.

In this design, it is provided that the clearing edge 14 comprises a first and second clearing edge section 20, 22.

The first clearing edge section 20 may be shaped in such a manner that, in operating position, the force acting on the first clearing edge section 20 as a result of penetrating the ground material 16 is directed in such a manner that at least a portion of the force pushes the clearing element 12 in the direction of the ground surface. In the embodiment depicted, the clearing edge features, at least in the first clearing edge section 20, having a first contour, which in operating position is curved, in the direction of the ground surface, in the direction of travel A.

The clearing edge 14 may comprise at least a second clearing edge section 22 featuring a second contour, which in operating position is curved, in the direction of the ground surface, in a direction opposite to the direction of travel A.

The second clearing edge section 22 may be shaped in such a manner that the clearing element 12 tapers towards the free end 24.

The clearing edge section 20 is preferably arranged above the second clearing edge section 22. The contour of the second clearing edge section 22 may be shaped in such a manner that, in operating position, the force acting on the second clearing edge section 22 as a result of penetrating the ground material 16 is directed in such a manner that at least a portion of the force pivots the clearing element 12 and moves it away from the ground surface.

The own weight and/or the force of the actuator element 19 and/or the contour of the first and/or second clearing edge section 20, 22 may thus be selectable in such a manner that the clearing element 12 may penetrate the ground material 16, which may exhibit a density that is lower than a predefined density. This selection may at least in part be accomplished by adjusting the force applied by the actuator 19.

The actual own weight, the force of the actuator element and the contour of the first and/or second clearing edge section 20, 22 are tested by means of comparative tests using different contours, different own weights and forces of actuator moments and different materials with different densities, and are then selected accordingly.

The clearing element 12 is preferably arranged, as depicted, on a travelling device 4 of the construction machine or mining machine.

Figure 3:
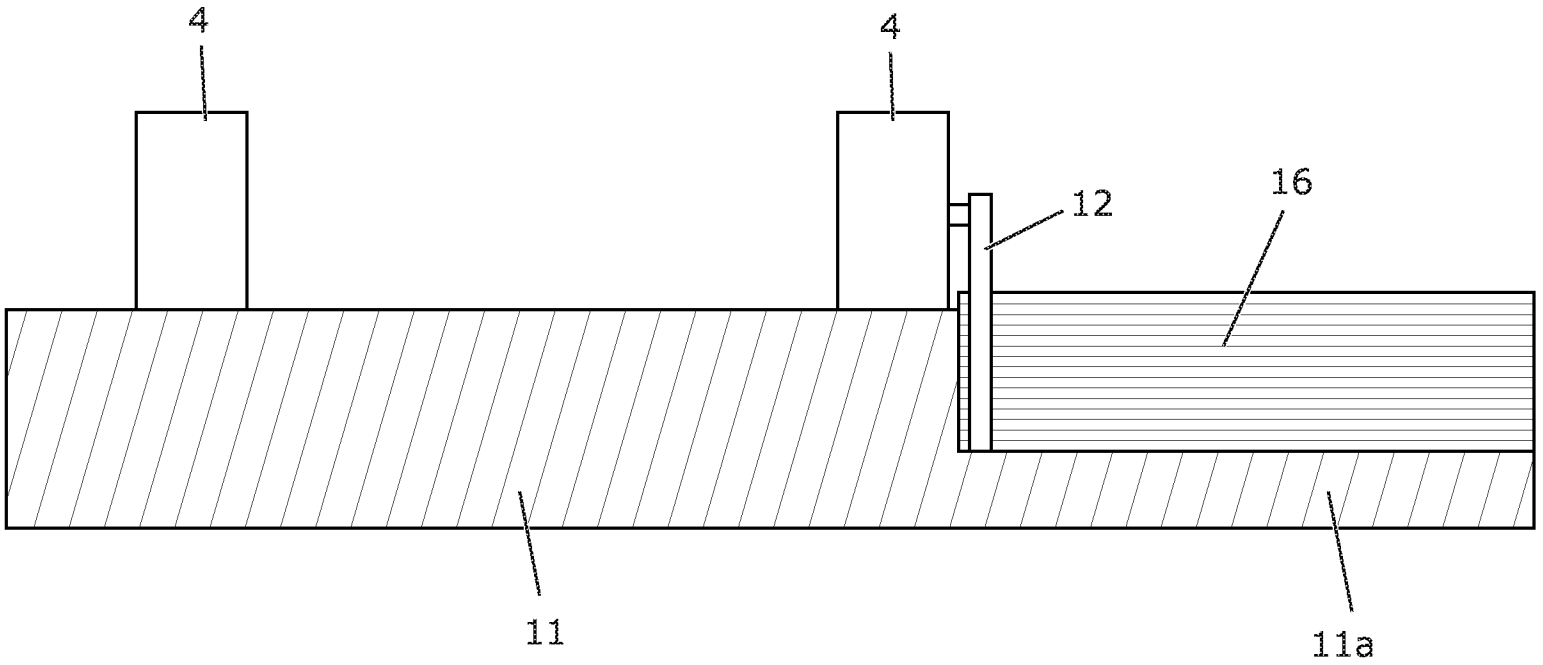
FIG. 3 a schematic view of the clearing element penetrating the ground material.

A schematic image is shown in FIG. 3, which schematically depicts the travelling devices 4 resting on the ground surface to be milled, as well as the clearing element 12. In the Figure shown, the clearing element clears the ground material 16 in front of the movable side plate 8 as seen in the direction of travel A. In the process, the clearing element 12 does not penetrate the area 11*a* of the ground surface 11, above which milling has already taken place.

Figure 4:
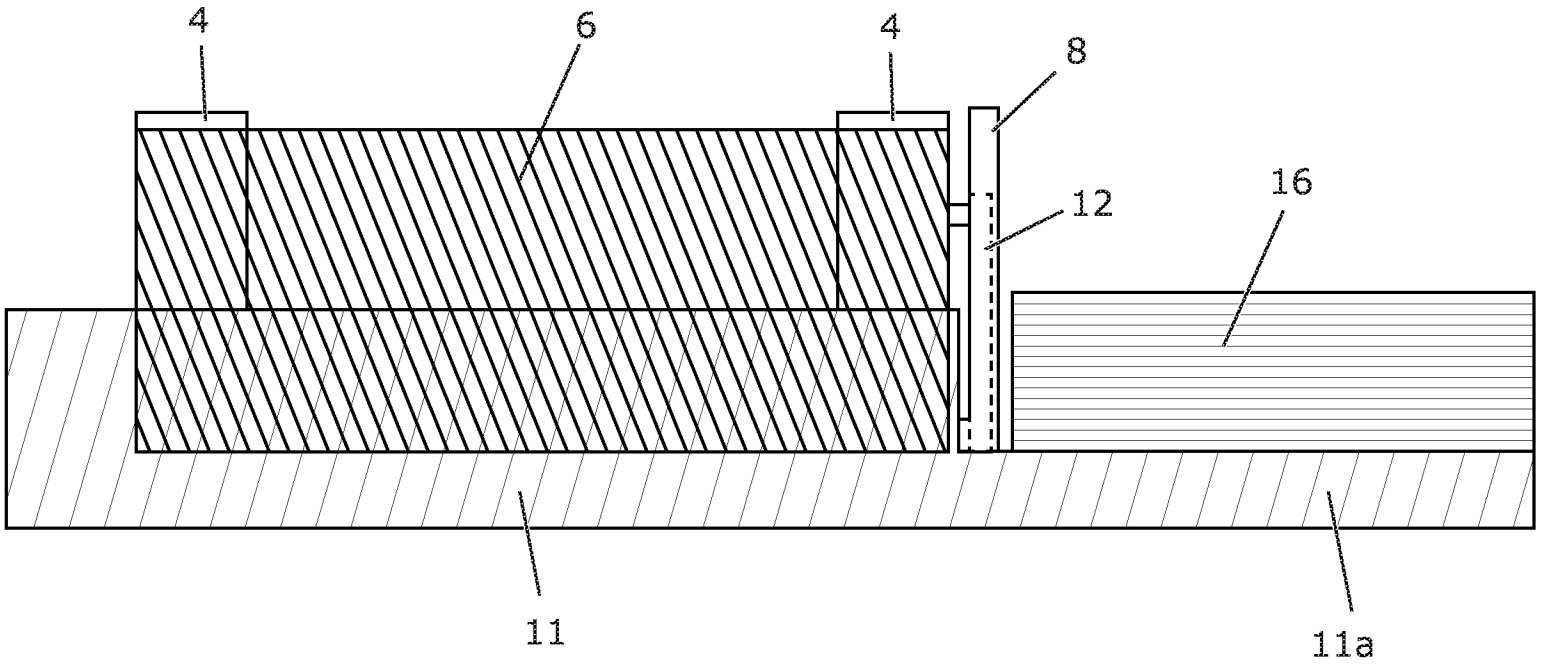
FIG. 4 a schematic view of the movable side plate.

FIG. 4 schematically shows the example in which the ground material 16 lying on the previously milled area 11*a* of the ground surface has already been cleared away. In this case, the movable side plate 8 may rest on the area 11*a* of the ground surface 11, above which milling has already taken place. The milling depth may therefore be determined by means of the movable side plate 8.

A method of operating the construction machine described above may include a step of clearing ground material 16 lying on the ground surface 11 in front of the movable side plate 8 with the clearing scraper 8 mounted on the construction machine 1 so that the movable side plate 8 rests on the ground surface 11.

The method may further include steps of:

previously milling a portion 11*a* of the ground surface so that the ground material 16 is previously milled ground material lying on the previously milled portion 11*a* of the ground surface;

milling a second portion of the ground surface 11 adjacent the previously milled portion of the ground surface as is seen in FIG. 4; and wherein the clearing step is further characterized as clearing the previously milled ground material 16 ahead of the movable side plate 8, while milling the second portion of the ground surface 11, so that the movable side plate 8 rests on the previously milled portion 11*a* of the ground surface as is seen for example in FIG. 4.

The method may further include a step of pivotally supporting the clearing scraper from one of the ground engaging units of the construction machine.

The invention claimed is:

1. A self-propelled construction machine for working a ground surface in a direction of travel, comprising:

a machine frame;

a milling drum supported from the machine frame for working the ground surface;

a milling drum housing receiving the milling drum, the milling drum housing including at least one movable side plate at least partially closing at least one side of the housing, the at least one movable side plate being configured to rest on the ground surface in a floating position during working operation of the milling drum; and a clearing scraper arranged in front of the at least one movable side plate as seen in the direction of travel, the clearing scraper including at least one clearing edge configured to penetrate ground material lying on the ground surface in front of the at least one movable side plate and to clear the ground material ahead of the at least one movable side plate so that the at least one movable side plate may rest on the ground surface.

2. The self-propelled construction machine of claim 1, wherein:

the clearing scraper is pivotable about a pivoting axis extending essentially orthogonal to the direction of travel.

3. The self-propelled construction machine of claim 2, wherein:

the pivoting axis is offset horizontally in relation to the at least one clearing edge.

4. The self-propelled construction machine of claim 3, wherein:

the pivoting axis is offset vertically in relation to the at least one clearing edge.

5. The self-propelled construction machine of claim 2, wherein:

the pivoting axis is offset vertically in relation to the at least one clearing edge.

6. The self-propelled construction machine of claim 1, wherein:

the at least one clearing edge includes a first clearing edge section including a first contour curved toward the ground surface and in the direction of travel when the clearing scraper is in an operating position.

7. The self-propelled construction machine of claim 6, wherein:

the at least one clearing edge includes a second clearing edge section including a second contour curved toward the ground surface and opposite to the direction of travel when the clearing scraper is in the operating position.

8. The self-propelled construction machine of claim 7, wherein:

the second contour is shaped such that the clearing scraper tapers toward a free end.

9. The self-propelled construction machine of claim 7, wherein:

in the operating position the first clearing edge section is arranged above the second clearing edge section.

10. The self-propelled construction machine of claim 1, wherein:

the clearing scraper is configured such that the at least one movable side plate may rest on a previously milled area of the ground surface with the clearing scraper penetrating previously milled ground material lying on the ground surface ahead of the at least one movable side plate.

11. The self-propelled construction machine of claim 1, wherein:

the clearing scraper is pivotable about a pivoting axis extending essentially orthogonal to the direction of travel; and the clearing scraper has a center of gravity arranged relative to the pivoting axis such that a weight of the clearing scraper pushes the clearing scraper toward the ground surface.

12. The self-propelled construction machine of claim 1, wherein:

the at least one clearing edge includes a first clearing edge section including a first contour curved such that when the clearing scraper is in an operating position a force acting on the first clearing edge section as a result of penetrating the ground material lying on the ground surface is directed in such a manner that at least a portion of the force pushes the clearing scraper toward the ground surface.

13. The self-propelled construction machine of claim 1, further comprising:

an actuator configured to apply a force to the clearing scraper to push the clearing scraper toward the ground surface.

14. The self-propelled construction machine of claim 13, wherein:

the clearing scraper is pivotable about a pivoting axis extending essentially orthogonal to the direction of travel; and the clearing scraper is configured such that when a force acting on the at least one clearing edge as a result of penetrating the ground material lying on the ground surface overcomes a weight of the clearing scraper and the force applied by the actuator, the clearing scraper is pivoted about the pivoting axis such that the clearing scraper moves away from the ground surface.

15. The self-propelled construction machine of claim 1, wherein:

the clearing scraper is pivotable about a pivoting axis extending essentially orthogonal to the direction of travel; and the at least one clearing edge includes a contour configured such that a force acting on the contour as a result of the contour penetrating the ground material lying on the ground surface is directed such that at least a portion of the force pivots the clearing scraper and moves the clearing scraper away from the ground surface.

16. The self-propelled construction machine of claim 1, further comprising:

an actuator configured to apply a force to the clearing scraper to push the clearing scraper toward the ground surface, the force being adjustable such that the clearing scraper may penetrate the ground material lying on the ground surface when the ground material has a density lower than a predefined density.

17. The self-propelled construction machine of claim 1, further comprising:

a plurality of ground engaging units configured to support the machine frame from the ground surface; and wherein the clearing scraper is mounted on one of the ground engaging units.

18. A method of operating a self-propelled construction machine for working a ground surface in a direction of travel, the construction machine including a machine frame, a plurality of ground engaging units supporting the machine frame from the ground surface, a milling drum supported from the machine frame for working the ground surface, and a milling drum housing receiving the milling drum, the milling drum housing including at least one movable side plate at least partially closing at least one side of the housing, the at least one movable side plate being configured to rest on the ground surface in a floating position during working operation of the milling drum, the method comprising:

clearing ground material lying on the ground surface in front of the at least one movable side plate with a clearing scraper mounted on the construction machine so that the at least one movable side plate rests on the ground surface.

19. The method of claim 18, further comprising:

previously milling a portion of the ground surface so that the ground material is previously milled ground material lying on the previously milled portion of the ground surface;

milling a second portion of the ground surface adjacent the previously milled portion of the ground surface; and wherein the clearing step is further characterized as clearing the previously milled ground material ahead of the at least one movable side plate, while milling the second portion of the ground surface, so that the at least one movable side plate rests on the previously milled portion of the ground surface.

20. The method of claim 18, further comprising:

pivotally supporting the clearing scraper from one of the ground engaging units of the construction machine.

* * * * *